US006156390A

United States Patent [19]

Henry et al.

[11] Patent Number: 6,156,390

[45] Date of Patent: Dec. 5, 2000

[54] PROCESS FOR CO-DEPOSITION WITH ELECTROLESS NICKEL

[75] Inventors: James R. Henry, Davenport, Iowa; Mark W. Henry, Moline, Ill.

[73] Assignee: Wear-Cote International, Inc., Rock Island, Ill.

[21] Appl. No.: 09/053,674

[22] Filed: Apr. 1, 1998

[51] Int. Cl.[7] ..... B05D 1/18

[52] U.S. Cl. ..... 427/438; 427/122; 427/437; 427/443.1

[58] Field of Search ..... 427/437, 438, 427/436, 122, 443.1, 443.2

[56] References Cited

U.S. PATENT DOCUMENTS

| | | | |
|---|---|---|---|
| Re. 33,767 | 12/1991 | Christini et al. | 428/544 |
| 4,830,889 | 5/1989 | Henry et al. | 427/438 |
| 4,997,686 | 3/1991 | Feldstein et al. | 427/443.1 |
| 5,674,631 | 10/1997 | Feldstein | 428/610 |

FOREIGN PATENT DOCUMENTS

0574587A1 12/1993 European Pat. Off. .

*Primary Examiner*—Shrive Beck
*Assistant Examiner*—Michael Barr
*Attorney, Agent, or Firm*—Rockey, Milnamow & Katz, Ltd.

[57] ABSTRACT

A process for the co-deposition of fluorinated carbon and diamond material with electroless metal in which the electroless plating bath is formulated to contain an aqueous dispersion of the fluorinated carbon, the finely divided diamond material and an electroless metal salt in aqueous suspension. the plating bath can be used to plate workpieces wherein the fluorinated carbon and diamond material are co-deposited in a plated electroless metal matrix. It has been found that the use of a finely divided diamond material having an average diameter less than 10 nm provides not only improved bath stability but also facilitates the codeposition of the diamond material and fluorinated carbon with the electroless metal.

8 Claims, No Drawings

PROCESS FOR CO-DEPOSITION WITH ELECTROLESS NICKEL

BACKGROUND OF THE INVENTION

The present invention relates to metal plating and more particularly to the co-deposition of fluorinated carbon and a diamond-containing material with electroless metal platings.

The field of electroless plating of metals is now well established, having begun in the 1940's at the United States National Bureau of Standard. Electroless metal plating is now widely used to deposit nickel, copper and gold platings in a variety of applications. In addition to nickel, copper and gold, it is also possible to deposit metals including palladium, cobalt, silver and tin, although the use of the latter metals is not nearly as widespread. The most widely used electroless metal deposition is nickel.

As is now well known and understood in the art, electroless plating refers to the autocatalytic or chemical reduction of aqueous metal ions plated on a base substrate. Deposits made by electroless plating have unique metallurgical characteristics. The coating formed thereby has uniformity, excellent corrosion resistance, wear and. abrasion resistance, nonmagnetic and magnetic properties, solderability, high hardness, excellent adhesion, low coefficient of friction and like properties as are understood in the art. Such deposits can be made onto a wide range of substrates, both metallic and nonmetallic.

Electroless bath compositions have likewise been well established in the prior art. Such baths typically contain an aqueous solution of metal ions to be deposited, catalysts, one or more reducing agents, one or more complexing agents and bath stabilizers, all of which are tailored to specific metal ion concentration, temperature and pH range. In electroless metal depositing, use is made of a chemical reducing agent, thus avoiding the need to employ a electrical current as required in conventional electroplating. Because the deposit is made from a bath, the deposit follows the contours of the substrate, without build-up at edges or corners of the substrate. A sharp edge receives the same thickness of deposit as a blind hole. Because the deposit is autocatalytic, the base substrate itself is preferably catalytic in nature, causing the reaction to occur once the base substrate is immersed in the bath to form a uniform deposit on the surfaces thereof.

In the electroless plating process, metal ions are reduced to metal through the action of chemical reducing agents serving as electron donors. The metal ions are electronic acceptors which react with the electron donors to form a metal which becomes deposited on the substrate. The catalyst is simply the substance, the workpiece or metallic surface provided to the bath, which serves to accelerate the electroless chemical reaction to allow oxidation and reduction of the metal ion to metal.

The following chemical formulae illustrate an "electroless reaction", i.e., electroless nickel (sodium hyphophosphite reduced) acid bath:

$$\{H_2PO_2]^- + H_2O \xrightarrow[\text{Heat}]{\text{Catalyst}} H+ + [HPO_3]^= + 2H$$

$$Ni^{++} + 2H \longrightarrow Ni + 2H^+$$

$$[H_2PO_2]^- + H \longrightarrow H_2O + OH^- + P$$

$$[H_2PO_2]^- + H_2O \longrightarrow H^+ + [HOP_3]^= + H_2\uparrow$$

The metal ion and reduced concentration must be monitored and controlled closely in order to maintain proper ratios and to maintain the overall chemical balance of the plating bath. The electroless plating deposition rate is controlled by temperature, pH and metal ion/reducing agent concentration. Each of the particular plating reactions has optimum ranges at which the bath should be operated.

Complexing agent(s) act as a buffer to help control pH and maintain control over the "free" metal salt ions available to the solution, thus allowing solution stability. The stabilizer (s) act as catalytic inhibitors, retarding potential spontaneous decomposition of the electroless bath.

Few stabilizers are used in excess of 10 PPM, because an electroless bath has a maximum tolerance to a given stabilizer. Excessive use of stabilization materials can result in depletion of plating rate, bath life and poor metallurgical deposit properties.

Trace impurities and organic contamination (i.e., degreasing solvents, oil residues, mold releases) in the plating bath will affect deposit properties and appearance. Foreign inorganic ions (i.e., heavy metals) can have an equal effect. Improper balance and control will cause deposit roughness, porosity, changes in final color, foreign inclusions and poor adhesion.

It is also known that various materials can be co-deposited in the formation of electroless metal coatings. U.S. Pat. No. 3,753,667 discloses a process for the electroless coating in which the nonmetallic, wear-resistant material is co-deposited with, for example, nickel in an electroless system. The wear resisting particles described are inorganic particles such as kaolin, silicates, as well as fluorides of various metals such as aluminum, boron, chromium and like metals. Similar teachings are contained in U.S. Pat. Nos. 4,997,686 and 5,145,517. The latter patents refer to co-depositing "particulate matter" with electroless deposition for the purpose of providing lubricity and resistance to wear, abrasion and corrosion. The latter patents include, as an essential component, a complex mixture of what the patents refer to as "particulate matter stabilizers" for the purpose of causing a significant shift in the zeta potential. Those stabilizers are surfactants, and the patents require a mixture of a nonionic surfactant in combination with another surfactant selected from the group consisting of anionic, cationic and amphoteric surfactants.

Substantial improvements over the subject matter of the latter two patents are disclosed in U.S. Pat. No. 4,830,889. That patent describes an improved process for depositing fluorinated carbon in an electroless metal plating process necessitating a combination of surfactants which include a non-ionic, non-fluorinated surfactant in combination with a cationic fluorinated surfactant, and preferably a cationic fluorinated in the form of an alkyl quaternary ammonium iodide surfactant.

It is accordingly an object of the present invention to provide a process for use in the electroless plating of metals which overcomes the foregoing disadvantages.

It is yet another object of the invention to provide a process for the co-deposition of two or more particulate matters insoluble in the bath for use in the electroless plating of various metals.

It is a more specific object of the present invention to provide a process for the electroless deposition of metals which are co-deposited with both fluorinated carbon and diamond-containing material wherein the diamond particles have a minimum average size to aid in the stability of the bath and the codeposition of the diamond-containing material with the fluorinated carbon.

These and other objects and advantages of the present invention will appear more fully hereinafter from the following description which is provided by way of illustration and not by way of limitation of the practice of the present invention.

SUMMARY OF THE INVENTION

The concepts of the present invention reside in a process for the co-deposition of fluorinated carbon, a diamond-containing material and an electroless metal wherein the diamond-containing material has an average particle size of less than 10 nm. In accordance with the practice of the invention, an electroless bath is formulated to include an aqueous solution of metal ions, one or more reducing agents and one or more complexing agents. It has been found that the electroless metal, the fluorinated carbon and the diamond-containing material can be formulated into a stable bath which can be used to co-deposit all three of the foregoing components of the bath wherein the finely divided diamond-containing material, because of its ultra-fine particle size, contributes to the stability of the bath instead of adversely affecting it.

The concepts of the present invention are particularly well suited for use in the electroless plating of nickel. Nonetheless, it will be understood by those skilled in the art that other electroless metals can likewise be co-deposited in place of nickel; such other metals include copper, gold, palladium, cobalt, silver and tin. Such metals are included in the bath as an aqueous solution of metal ions selected from the foregoing group in combination with a reducing agent whereby the metal is co-deposited with the fluorinated carbon and the diamond-containing material.

As the diamond-containing material, use can be made of any of a variety of diamond-containing materials having an average size or particle size range of less than 10 nm. One suitable source of the diamond-containing materials are finely divided material diamonds as well as synthetic diamonds. Synthetic diamonds may be prepared in accordance with the techniques described in European Patent Application 00574587A1 published Jul. 5, 1993. Such diamond-containing materials are commercial available from Diamond Technologies Inc. under the trademark "ultradiamond90". Such diamond-containing materials are prepared by detonating a carbon-containing explosive material with a negative oxygen balance in a closed volume in an atmosphere of gases inert to carbon, all as described in the foregoing published European patent application, the disclosure of which is incorporated herein by reference. In the preferred practice of the invention, the oxygen contained in the closed volume ranges from about 0.1 to about 6% by volume and the reaction is carried out at a temperature within the range of 300° to 360° Kelvin in the presence of ultra-dispersed carbon phase having a concentration within the range of 0.01 to 0.15%. Such synthetic diamonds in the form of round or irregular shapes having an average diameter of less than 10 nm, and preferably within the range of 1 to 10 nm having a surface area preferably less than 325 square meters per gram.

As the fluorinated carbon, use is preferably made of the fluorinated carbon disclosed in U.S. Pat. No. 4,830,889 sold commercially as ACCUFLUOR $CF_x$ or as carbon monofluoride sold by Elf Atochem as Product No. 6576. That material is a fluorinated carbon made by reacting coke with elemental fluorine whose characteristics are set forth in detail in the foregoing patent, the disclosure of which is incorporated herein by reference.

DETAILED DESCRIPTION OF THE INVENTION

In the practice of the present invention, the electroless metal plating bath is formulated by first suspending the fluorinated carbon in an aqueous medium, and preferably deionized water using vigorous agitation. Once the fluorinated carbon has been dispersed in the aqueous medium, the diamond-containing material is slowly added with continuing agitation to ensure that the diamond-containing material is equally uniformly dispersed in the aqueous medium along with the fluorinated carbon. Thereafter, the metal salt of the electroless metal is added along with the reducing agent while continuing the agitation to substantially uniformly disperse the components.

As indicated, use can be made of an electroless metal of a variety of metals, but electroless nickel is preferred. Electroless nickel baths may be any of four types, alkaline nickel phosphorous, acid nickel phosphorous, alkaline nickel-borax and acid nickel-boron. The chemical reducing agent most commonly used is sodium hypophosphite, although use can also be made of sodium borohydride, N-dimethylamine borane (DMAB), N-diethylamine borane (DEAB) and hydrazine. The alkaline nickel phosphorous baths, typically utilizes sodium hypophosphate as the reducing agent, are more frequently used at low temperature for plating on plastics. Such alkaline conditions frequently provide less corrosion protection, less adhesion to steel and difficulties in processing aluminum by reason of the higher pH levels.

Illustrating such alkaline baths is electroless nickel is the following:

| | |
|---|---|
| Nickel sulfate | 30 g/L |
| Sodium Hypophosphite | 30 g/L |
| Sodium Pyrophosphate | 60 g/L |
| Triethanolamine | 100 ml/L |
| pH | 10.0 |
| Temperature | 30–35° C. (86–95° F.) |

The foregoing bath can be used to produce hardness values of 700 BHN at 2% phosphorous using lower temperatures below 100° F. An example of a high temperature alkaline electroless nickel bath is set forth as follows:

| | |
|---|---|
| Nickel sulfate | 33 g/L |
| Sodium citrate | 84 g/L |
| Ammonium chloride | 50 g/L |
| Sodium hypophosphite | 17 g/L |
| pH | 9.5 |
| Temperature | 85° C. (185° F.) |

Acid baths, on the other hand, are typically formulated to contain 88–98% nickel and 6–12% by weight phosphorous operating at temperatures within he range of about 150–200° F. over a pH range of about 4.0 to 6.0. The reducing agent most commonly used is sodium phosphite. As is well known in the art, the pH of the solution frequently controls the phosphorous content of the deposit. Generally, the use of higher pHs reduces the phosphorous content of the deposit coating. Lower phosphorous-containing deposits, of the order of about 6% by weight, typically provide less corrosion resistant than deposit containing 9% phosphorous. In addition, the deposit containing phosphorous in excess of 8% are typically nonmagnetic.

The relative proportions of the fluorinated carbon and the diamond-containing material can be varied within relatively wide ranges, depending somewhat on the application intended for the coated substrate. In general, the amount of the diamond-containing material, because of its cost, is frequently maintained at a somewhat lower level than that of either the electroless metal or the fluorinated carbon. It will be understood, however, by those skilled in the art that, where necessary, the amount of the diamond-containing material can be substantially increased for co-deposition with the electroless metal and the fluorinated carbon. In general, good results are obtained when the concentration of the electroless metal salt is within the range of about 20 to 50 grams per liter, the amount of the fluorinated carbon is within the range of about 5 to 40 grams per liter and the amount of the diamond-containing material ranges from about 0.1 to 10 grams per liter. Nonetheless, those relative proportions are subject to considerable variation depending on the application of the coated substrate.

It is generally preferred that the electroless nickel bath be formulated separately with the reducing agent and the complexing agent. To the electroless metal bath is then added the suspension of the fluorinated carbon and the diamond-containing material in the appropriate proportions. The amount of the reducing agent is not critical and can likewise be varied within wide ranges. Typically, the reducing agent may be present in amounts ranging from 20 to 200 grams per liter. Similarly, the complexing agent, typically a buffer system such as sodium acetate and citric acid, lead acetate, triethanolamine or ethylenediamine can likewise be varied within wide ranges, typically ranging from 0 to 50 grams per liter based on the total weight of the bath. As will be appreciated by those skilled in the art, other complexing agents may likewise be used in place of these specific complexing agents described above.

In the preferred practice of the invention, the bath is preferably formulated in accordance with the procedures disclosed and claimed in U.S. Pat. No. 4,830,889, the disclosure of which is incorporated herein by reference, wherein a combination of surfactants or wetting agents is employed. In the preferred practice of the invention, use can be made of an ionic wetting agent in combination with a cationic wetting agent, all as described in the foregoing patent.

Once the bath has been prepared and is maintained in suspension, it is ready for use in the electroless plating method of the present invention. Since electroless plating is a chemical reduction process, proper surface preparation of the substrate is important in achieving a sound electroless deposition. Improper adhesion, deposit porosity and skip plating can be the by-product of a poorly prepared substrate. In the preferred practice of the invention, the substrate is treated to remove, either mechanically, chemically or both, all surface contamination and exposing the substrate to its virgin or activated stage for electroless plating.

Typical surface contamination results from the presence of oxides, buffing compounds, oils, greases or other lubricants should preferably be removed. Apart from mechanical cleaning, chemical cleaning using solvents or other conventional metal cleaning components may likewise be used.

The substrate can then simply be immersed in the electroless plating bath containing the electroless metal salt, the fluorinated carbon and the diamond-containing material and the bath heated to an elevated temperature to initiate the reduction of the electroless metal salt to effect co-deposition of the electroless metal with the fluorinated carbon and the diamond-containing material. Depending somewhat on the application to which the other substrate is put, the temperature can be varied within wide ranges. In general, good results are obtained when the bath is heated to a temperature within the range of about 80° F. to near the boiling point of the bath, typically around 200° F. An important consideration in the temperature selected is a temperature that does not substantially effect structural changes in the base substrate. The use of elevated temperatures can likewise be effective to relieve any hydrogen embrittlement produced by hydrogen liberated during the electroless metal deposition.

As is well known to those skilled in the art, post baking of the coating can be used to control the structural properties of the deposit. Dependent somewhat on the temperature, bath composition and the phosphorous content, post bake of the deposit can be used to change the initial microcrystalline structure of the electroless metal coating. For example, post baking can be employed to produce precipitation of metal phosphides to form a very hard matrix coating on the substrate.

Having described the basic concepts of the invention, reference is now made to the following examples which are provided by way of illustration and not be way of limitation of the practice of the invention.

In the following examples, the electroless metal bath is formulated to include nickel sulfate as the electroless metal salt. The fluorinated carbon ($CF_x$) was the same fluorinated carbon described in U.S. Pat. No. 4,830,889 having the characteristics set forth therein. The source of the diamond-containing material is Ultra Diamond Technologies of Deerfield Beach, Fla. which markets ultradiamond90 ("UD90") which has the appearance of a gray powder containing 92.8% diamond material, 4.4% ash and 2.8% of oxidatable forms of carbon. UD90 has a surface area of 275 $m^2/g$ and has a particle size ranging from 3 to 8 nm with an average particle size of 5 nm.

The electroless nickel bath used in each of the following examples had the following composition:

| | |
|---|---|
| Nickel sulfate | 28 g/L |
| Sodium acetate | 17 g/L |
| Sodium hypophosphite | 24 g/L |
| Lead acetate | 0.0015 g/L |
| pH | 4.5–4.6 |
| Temperature | 82–88° C. (180–190° F.) |

EXAMPLE 1

A premix suspension of the $CF_x$ fluorinated carbon particles and UD90 is prepared by mixing 10 grams of $CF_x$ in 500 ml of deionized water and a combination of a fluorinated alkylpolyoxethylene ethanol (Fluorad FC-170-C) (a non-ionic surfactant) and Fluorad FC-99, an anionic surfactant, both from the 3M Company for approximately an hour to form a wetted suspension. Thereafter, 5 g of UD90 is added and the resulting suspension agitated for another 30 minutes to form an aqueous suspension of the $CF_x$ and UD90. That premix suspension is then blended with the electroless nickel bath described above in proportions such that the nickel sulfate contained was 28 g per liter, the $CF_x$ contained was 10 g per liter and the UD90 diamond-containing material constituted 5 g per liter with mild agitation using a magnetic stirrer. The electroless nickel bath having a pH of about 4.6 is heated to approximately 180° F. and steel test panels were plated for 45 minutes, 1.5 hours and 2 hours. Microscopic examination of the test specimens at the end of 2 hours revealed that both the fluorinated carbon and the diamond particles are co-deposited with the nickel to form a hardy and extremely low wear surface with moderate coefficient of friction.

EXAMPLE 2

In this example, the same conditions as described in Example 1 were used, except that the concentration of $CF_x$ particles was increased to 20 g per liter and the diamond content remained the same. Once again, both the $CF_x$ particles and the diamond particles were co-deposited with the nickel to form a hard surface.

EXAMPLE 3

This example illustrates a comparison of Taber Abrasion Wear Test Results for steel samples coated with electroless nickel alone, electroless nickel plus $CF_x$ as described in Example 12 of U.S. Pat. No. 4,830,889, electroless nickel plus diamond-containing material UD90 alone and test samples prepared in accordance with production of the present invention in which electroless nickel $CF_x$ and UD90 are simultaneously co-deposited. The Taber Abrasion Wear Index set forth in this example is a measure of the abrasion wear resistance of the tested material and is defined as the specimen weight loss in milligrams per thousand cycles of test. That volume can be determined graphically by plotting the cumulative weight loss versus cycles of test, or mathematically through linear regression analysis. In either case, the first 1,000 cycles and the results they provide is ignored. For purposes of comparison, conventional methods for the electroless deposition of nickel alone provide abrasion wear index values ranging between 18 and 25 mg/1,000 test cycles.

The Taber Abrasion Wear Test Results have 5,000 cycles of tests and 30,000 cycles of tests as set forth below:

| | Wt. Loss Grams | Wt. Loss mg/Cycle |
|---|---|---|
| 5,000 Cycle Test @ 1,000 Gram (2.2#) Load | | |
| Electroless Nickel—heat treated | .0612 gm (61.2 mg) | 12.24 mg/cycle |
| Electroless Nickel Plus $CF_x$—heat treated | .0523 gm (52.3 mg) | 10.46 mg/cycle |
| Electroless Nickel Plus $CF_x$/UD90 Mix—as deposited | .0372 gm (37.2 mg) | 7.44 mg/cycle |
| Electroless Nickel Plus $CF_x$/UD90 Mix—heat treated | 0.114 gm (11.4 mg) | 2.28 mg/cycle |
| 30,000 Cycle Test @ 1,000 Grams (2.2#) Load | | |
| Electroless Nickel/UD90 Mix—as deposited | .1154 gm (115.4 mg) | 3.85 mg/cycle |
| Electroless Nickel/UD90 Mix—heat treated | .0410 gm (41.0 mg) | 1.37 mg/cycle |
| Electroless Nickel Plus $CF_x$/UD90 Mix—heat treated | .0374 gm (37.4 mg) | 1.25 mg/cycle |

As can be seen from the foregoing test data, electroless nickel, even after heat treatment, lost 12.24 mg per cycle of the deposited coating while electroless nickel plus $CF_x$ resulted in a weight loss of 10.46 mg per cycle, each at 5,000 cycles. With the product produced according to the present invention utilizing co-deposition of electroless nickel, $CF_x$ and the diamond-containing material, weight loss was drastically reduced, both as deposited and even more drastically reduced after heat treatment. Similarly, weight loss was markedly reduced for the co-deposition of all three components after 30,000 cycles as compared to co-deposition of electroless nickel plus UD90. From the same data, it can be inferred that the coefficient of friction is likewise low, resulting in low wear.

It will be understood that various changes and modifications can be made in the details of procedure, formulation and use without departing from the spirit of the invention, especially as defined in the following claims.

What is claimed is:

1. A process for the co-deposition of fluorinated carbon and diamond material with electroless metal comprising the steps of:

(a) introducing a workpiece into a plating bath containing a metal salt serving as a source of electroless metal for plating, a fluorinated carbon, finely divided diamond material having an average particle size less than 10 nm wherein the finely divided diamond material is prepared by the detonation of a carbon-containing substance with a negative balance in a closed volume in an atmosphere inert to carbon and a surfactant combination comprising a non-ionic wetting agent and a cationic wetting agent, and (b) initiating an electroless plating process to form a plated workpiece including co-deposit of fluorinated carbon and diamond material substantially uniformly dispersed in a plated metal matrix.

2. A process as defined in claim 1 wherein the electroless metal is electroless nickel.

3. A process as defined in claim 1 wherein the diamond-containing material is in the form of synthetic diamonds having round or irregular shapes with an average diameter within the range of 1 to 5 nm.

4. A process as defined in claim 3 where the diamond-containing material has a surface area less than 325 $m^2/g$.

5. A process as defined in claim 1 wherein the bath includes a chemical reducing agent.

6. A process as defined in claim 1 wherein the electroless metal salt in the bath has a concentration within the range of 20 to 50 g/L.

7. A process as defined in claim 1 wherein the bath contains fluorinated carbon in a concentration of 5 to 50 g/L.

8. A process as defined in claim 1 wherein the diamond-containing material in the bath has a concentration of about 0.1 to 10 g/L.

* * * * *